US005338013A

United States Patent [19]

Lonardi et al.

[11] Patent Number: 5,338,013

[45] Date of Patent: Aug. 16, 1994

[54] MACHINE FOR PIERCING A TAPHOLE FOR A SHAFT FURNACE

[75] Inventors: Emile Lonardi, Bascharage; Jean Metz, Luxembourg; Pierre Mailliet, Luxembourg-Howald; Guy Thillen, Diekirch; Radmir Andonov, Mamer; Philippe Malivoir, Thionville, all of Luxembourg

[73] Assignee: Paul Wurth S.A., Luxembourg

[21] Appl. No.: 8,128

[22] Filed: Jan. 22, 1993

[30] Foreign Application Priority Data

Jan. 24, 1992 [LU] Luxembourg ..... 88 058

[51] Int. Cl.[5] ..... C21C 5/48

[52] U.S. Cl. ..... 266/271; 266/45

[58] Field of Search ..... 266/271, 272, 273, 44, 266/45, 195

[56] References Cited

U.S. PATENT DOCUMENTS

| | | | |
|---|---|---|---|
| 4,602,770 | 7/1986 | Mailliet et al. | 266/271 |
| 5,069,430 | 12/1991 | Woodings et al. | 266/271 |
| 5,192,489 | 3/1993 | Metz et al. | 266/271 |

FOREIGN PATENT DOCUMENTS

| | | |
|---|---|---|
| 00025423 | 3/1981 | European Pat. Off. . |
| 00128432 | 12/1984 | European Pat. Off. . |
| 00379018 | 7/1990 | European Pat. Off. . |
| 3339127A1 | 5/1985 | Fed. Rep. of Germany . |
| 2207741A | 2/1989 | United Kingdom . |

*Primary Examiner*—Scott Kastler

*Attorney, Agent, or Firm*—Fishman, Dionne & Cantor

[57] ABSTRACT

A machine and method is provided for piercing a taphole for a shaft furnace. The machine comprises a mounting, with a support installed on the mounting so as to support a rod at the front of the mounting, a rear support which can move on the mounting and is provided with means for being coupled to the rear end of the rod and a clamp mounted in a sliding manner on the mounting and designed to grip the rod at any place between the front support and the rear support. A powerful rotary motor installed at the rear of the mounting drives an endless chain installed axially in the mounting. A clamp attached to the endless chain moves during the insertion of the rod into the taphole clay by reversal of the direction of rotation of the motor in a to-and-fro motion between a position (B) at the front of the mounting and a position (A) which is located at a distance L from the position (B).

12 Claims, 4 Drawing Sheets

MACHINE FOR PIERCING A TAPHOLE FOR A SHAFT FURNACE

BACKGROUND OF THE INVENTION

The present invention relates to a machine for piercing a taphole for a shaft furnace, and more particularly to the so-called lost rod method used for piercing a taphole for a shaft furnace used in the production of steel. The lost rod method comprises blocking the taphole with taphole clay. Before the taphole clay has fully hardened, a metal rod is driven into and through this clay to a desired distance into the shaft furnace. At the appropriate time, the metal rod is extracted to open the taphole. The machine of the present invention comprises a mounting which has a support for the piercing rod at the front end. A rear support which can move slidably on the mounting is provided with coupling means for the rear end of the piercing rod. A clamp is provided which is slidable on the mounting and is designed to grip the piercing rod at any place between the front support and the rear support.

The prior art machines used previously to the present invention for this lost rod method are substantially conventional drilling apparatuses (i.e., drilling apparatuses designed for working with a drill bit). These conventional drilling machines have undergone appropriate adaptations and modifications to make them suitable for use in the lost rod method.

The main working members of these drilling machines is comprised of a chuck, a coupling clamp for the piercing rod, and a bi-directional pneumatic hammer. It should be noted that a high powered pneumatic hammer is required to deliver the large forces necessary for the insertion and extraction of the lost piercing rod.

In most cases, the above machines do preserve the possibility of being able to use a drilling apparatus with a bit. This feature is desirable in the cases where a taphole must be reformed or the taphole's location must be changed. Also, it is desirable to be able to work with a conventional bit if for some reason or another, the lost rod method cannot be used.

However, a powerful, large pneumatic hammer, as is used on these prior art machines, is not without considerable drawbacks. One major drawback is that the pneumatic hammer exerts considerable amount of stresses and vibrations on the equipment. As a result, in particular, the rod-coupling clamp is subjected to rapid wear. Another major drawback is that the pneumatic hammer is extremely noisy, and very often cannot conform to ever-stricter standard aimed at reducing the noise level in an industrial environment.

The patent application EP-0-379-018 and Luxembourg patent application 87 927 corresponding to U.S. application Ser. No. 462,415 filed Jan. 9, 1990, all the contents of which are incorporated herein by reference, provides an excellent method for extracting the piercing rod from a shaft furnace. This method relies on the action of a silent hydraulic jack to extract the piercing rod in several phases by means of a to-and-fro motion of a clamp acted upon by this silent hydraulic jack. This eliminates the need of a bi-directional pneumatic hammer since the pneumatic hammer is no longer required for use in the extraction of the piercing rod. The pneumatic hammer is still, however, required for efficient and rapid installation of the piercing rod.

The disadvantages of the pneumatic hammer, previously discussed, make it desirable to eliminate the percussion of the pneumatic hammer during the insertion phase of the piercing rod into the taphole. It is possible to subject the working member to a much more powerful driving means to advance the working member coupled to the piercing rod along the mounting in the direction of the taphole without vibrations into the semi-hardened sealing clay. Unfortunately, because of the length of the piercing rod, a too strong driving force can cause the piercing rod to buckle and could then be permanently blocked in a position which would not allow the piercing rod to be further driven into or extracted from the rapidly hardening taphole clay.

A better solution to the foregoing problem as discussed above, is suggested in the Luxembourg patent application LU-87-915, filed on Apr. 3, 1991, corresponding to U.S. application Ser. No. 862,487 filed Apr. 2, 1992, all the contents of which are incorporated herein by reference. This patent application comprises a bi-directional clamp whose reciprocating to-and-fro motion, produced by a hydraulic jack at the front of the mounting, is used both for the insertion and for the extraction of the piercing rod. U.S. application Ser. No. 862,487 does make it possible to eliminate the noisy and clamp-damaging pneumatic hammer. A disadvantage of the machine described in U.S. application Ser. No. 862,487 is that the bi-directional clamp and the means which actuate the bi-directional clamp always operate in the front region of the mounting. However, this region is a zone which is at risk of being splashed when the molten jet stream escapes from the taphole after extraction of the rod.

The problem of damage due to splashing in the preceding paragraph is resolved in Luxembourg patent application LU-88-029, filed Oct. 31, 1992, corresponding to U.S. application Ser. No. 968,984 filed Oct. 30, 1992, all the contents of which are incorporated herein by reference. This machine basically comprises two jacks. The first jack is mounted in a sliding manner on the mounting in such a way that the first jack can move along the mounting when urged by the second jack. The piercing rod is no longer extracted by a reciprocating to-and-fro motion of the clamp, but by a continuous withdrawal motion of the clamp under the combined action of the two hydraulic jacks. The clamp is cleared from the splash zone at the front of the mounting before the molten jet stream escapes from the taphole. A further advantage is that the extraction of the piercing rod is much speedier, since the extraction is carried out by a continuous movement compared to the intermittent movements involved in the to-and-fro movement by the clamp previously used.

U.S. application Ser. No. 968,984 described above only is involved in the extraction of the piercing rod. The piercing rod is inserted in the same manner as depicted in U.S. application Ser. No. 862,487. The clamp used in inserting the piercing rod under U.S. application Ser. No. 862,487 is acted upon with a reciprocating to-and-fro motion under the action of the first jack, after the first jack has been advanced into the operative position by the second jack.

The method for extraction of the piercing rod provided in U.S. application Ser. No. 968,984 provides satisfactory operation. A drawback of U.S. application Ser. No. 968,984 is that there is a considerable increase in the bulk and overall length of the machine. This is not desirable and can interfere with operation because of the lack of available space around the shaft furnace.

SUMMARY OF THE INVENTION

The above-discussed and other drawbacks and deficiencies of the prior art are overcome or alleviated by the machine for piercing a taphole for a shaft furnace of the present invention. The aim of the present invention is to provide a machine that can both drill a taphole for a shaft furnace and can also implement the lost rod method similar to U.S. application Ser. No. 968,984. The present invention substantially reduces the overall length with respect to the machine provided for in U.S. application Ser. No. 968,984.

The present invention comprises a machine designed for drilling a taphole, a large rotary motor installed at the rear of the mounting, and at least one endless chain (installed axially in the mounting between its front end and its rear end) which is driven by the rotary motor. The clamp is attached to the endless chain in such a way that the clamp can be driven by the chain between the front end and the rear end of the mounting or in the reverse direction. Means are provided for controlling the rotary motor so that during the insertion of the piercing rod into the taphole clay, reversal of the direction of the rotary motor will cause the clamp attached to the chain to move with a to-and-fro motion.

It will be appreciated that the machine according to the present invention is compatable with the piercing rod insertion and extracting method described by U.S. application Ser. No. 968,984.

The clamp used in the machine of the present invention is a bi-directional clamp as defined in the U.S. application Ser. No. 862,487.

The unidirectional clamp described in U.S. application Ser. No. 462,415 can also be used. However, this clamp must be mounted in the opposite direction of the clamp of U.S. application Ser. No. 862,487. U.S. application Ser. No. 462,415 can be used solely for driving the piercing rod into the taphole. When U.S. Application Serial No. 862,487 is used, the rear sliding support of the mounting must be provided with a second clamp intended for the extraction of the piercing rod. This second clamp could be a clamp such as is described in Luxembourg patent LU-87-546, filed Jun. 30, 1989, corresponding to U.S. Pat. No. 5,056,968, all the contents of which are incorporated herein by reference. The first clamp, which is open, bears on the second clamp and then pushes the sliding support coupled to the end of the rod towards the rear, thus clearing the piercing rod from the taphole.

One advantage of the machine of the present invention is its substantially reduced length with respect to a machine such as is described in U.S. application Ser. No. 968,984. It should be noted that the difference in length between the machine described in U.S. application Serial No. 968,984 and that of the present invention corresponds approximately to the travel of the to-and-fro motion during the insertion of the piercing rod, that is the length of the first hydraulic jack, installed behind a carriage supporting the clamp in order to produce the said to-and-fro motion.

Another important advantage of the machine of the present invention is its considerably reduced height. The driving chain may be easily integrated into the mounting, whereas the hydraulic cylinders of U.S. application Ser. No. 968,984 had to be fastened to the mounting because of their bulk, precluding such integration of the driving chain.

The present invention comprises a mounting, and a piercing rod support fastened at the front end of the mounting. A rear support which can move slidably on the mounting is provided with coupling means for the rear end of the piercing rod. A clamp is provided which is slidable on the mounting and is designed to grip the piercing rod at any place between the front support and the rear support. A large rotary motor is installed at the rear of the mounting. At least one endless chain is installed axially in the mounting between its front end and rear end and is driven by the rotary motor.

The clamp is attached to the endless chain in such a way that the clamp can be driven by the chain between the front end and the rear end of the mounting or in the reverse direction. Control means are provided for the rotary motor so that during insertion of the piercing rod into the taphole clay, reversal of the direction of the rotary motor will cause the clamp attached to the driving chain to move with a to-and-fro motion.

The clamp travels between a position B at the front of the mounting and a position A which is located at a distance L from position B, the distance L being less than the length of the piercing rod.

A summary of the operation of the present invention is as follows:

The piercing rod is passed through the opening in the front rod support, then through the clamp and into the rear sliding rod support and coupling. By rotation of the rotary motor in the first direction, the open clamp is brought to a certain distance L from the front of the mounting. The clamp is closed and the piercing rod is made to advance by means of the clamp by the length L by a rotation of the rotary motor in the same first direction. The clamp is then opened and the clamp is once again brought back to the distance L from the front of the mounting by a rotation of the motor in the opposite direction. The clamp is closed and the rod is advanced by a second length L.

This to-and-fro motion of the clamp over the distance L is repeated until the piercing rod is driven into the taphole by the desired length or depth. The distance L is determined so as to prevent the piercing rod from buckling during its insertion.

To extract the piercing rod, the rear piercing rod support and coupling is firmly attached to the piercing rod and to the clamp located at the front of the mounting. The piercing rod is pulled out or extracted by the endless chain in a continuous movement from the taphole.

The above-discussed and other features and advantages of the present invention will be appreciated and understood by those skilled in the art from the following detailed description and drawing.

BRIEF DESCRIPTION OF THE DRAWINGS

Referring now to the drawings wherein like elements are numbered alike in the several FIGURES:

FIG. 4 is a diagrammatical plan view of the machine of FIG. 4.

DESCRIPTION OF THE PREFERRED EMBODIMENT

Figure 1:
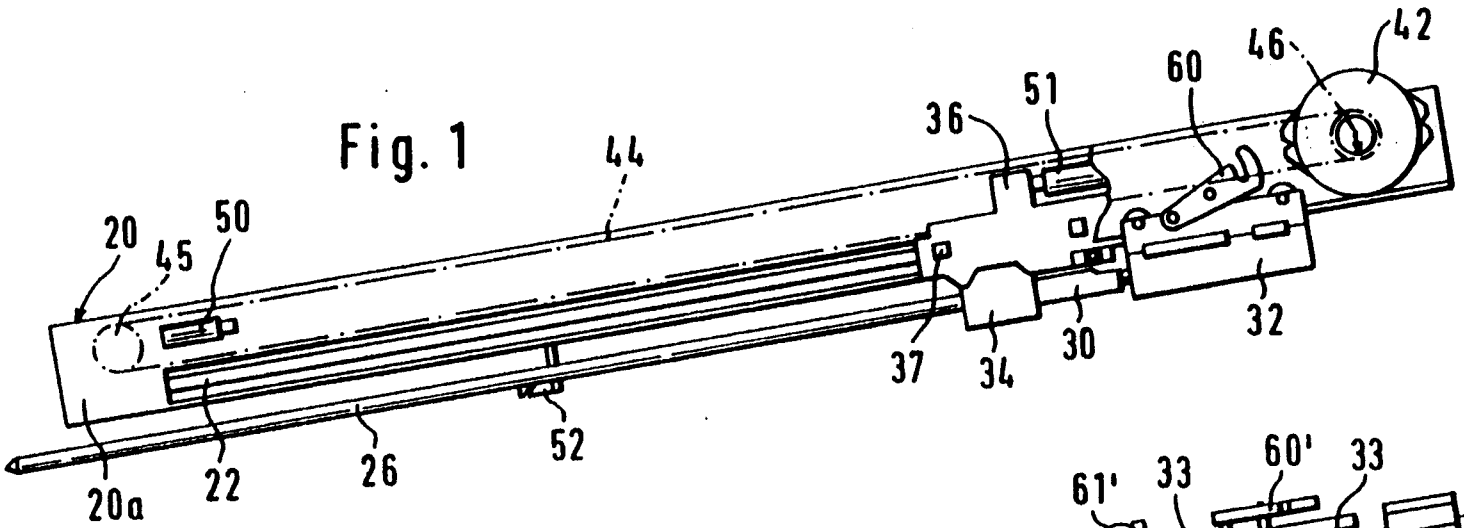
FIG. 1 is a diagrammatical front elevation view of the machine for piercing a taphole for a shaft furnace according to the present invention, shown in the position in which the machine is prepared for the insertion of a piercing rod into the taphole clay.
Figure 1A:
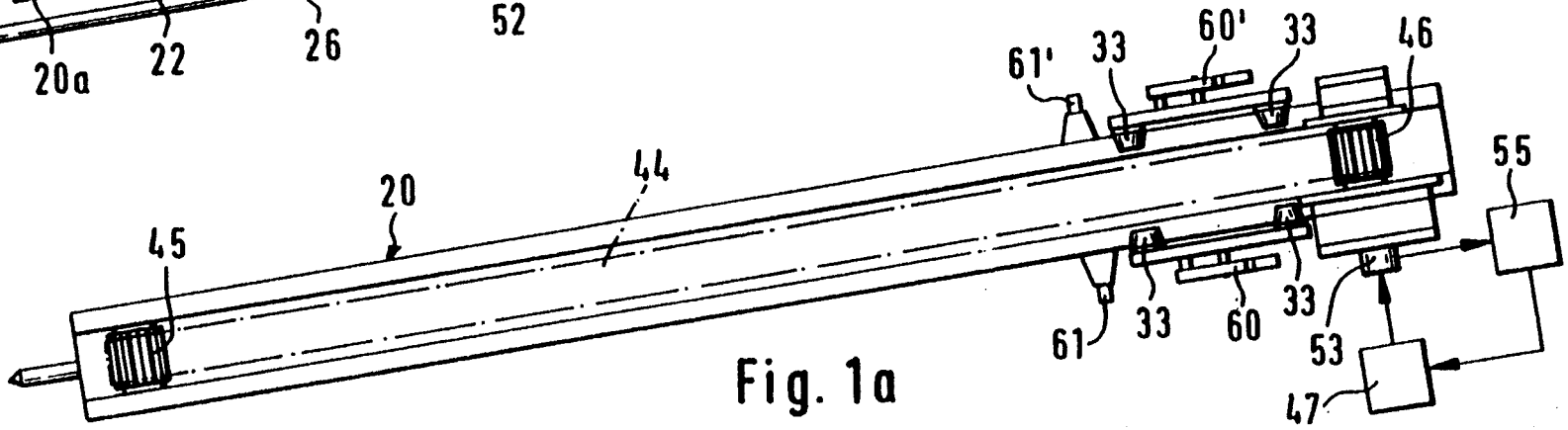
FIG. 1*a* is a diagrammatical plan view of the machine for piercing a taphole for a shaft furnace of FIG. 1, shown in the position in which the machine is prepared for the insertion of a piercing rod into the taphole clay.

Referring both to FIG. 1 and FIG. 1a, a preferred embodiment of a machine for piercing a taphole for a shaft furnace is diagrammatically shown in both front elevation and plan views. The framework of the piercing machine consists of a mounting generally shown at 20. This mounting is usually supported in a conventional and known manner at the end of a supporting arm (not shown). This supporting arm may pivot about a bracket allowing movement of the piercing machine between a parked position and an operative position.

The mounting 20 is generally formed by joining or fastening two parallel beams together. FIG. 1 shows only the beam 20aat the front of the mounting. The parallel beam 20b is not depicted in order to show more details of the machine without cluttering FIGS. 1 and 1a. The two beams 20a and 20b comprise, on their inner face, two rails 22 and 24 arranged face-to-face. Rail 22 only is shown in FIG. 1 for clarity.

Item 26 designates a piercing rod, still referred to as a lost rod. Piercing rod 26 is carried, at the front of the machine, by a support 52, which may, e.g., be a sliding support, of the type described in patent GB-2-216-827, corresponding to U.S. Pat. No. 5,039,068, all the contents of which are incorporated herein by reference.

It is, however, also possible to use a fixed support of the type provided in the European patent application EP-0-064-644, all the contents of which are incorporated herein by reference. This support comprises two flaps mounted at the front of the mounting 20 and is capable of pivoting between an open position facilitating the engagement and grasping of the piercing rod 26 (for extraction of piercing rod 26) and a position where the flaps define an opening between the flaps for the passage and support of the piercing rod 26. Thus, the two flaps constitute a support and at the same time form a shield protecting against splashes coming from the jet stream from the shaft furnace taphole.

At the rear of the machine, the piercing rod 26 is supported by a second support (30,32) which can follow the movement of the piercing rod 26. This second support comprises a rod coupling 30 firmly attached to a working member 32. Working member 32 is supported by a carriage sliding freely along the mounting 20. This is accomplished by means of several rollers 33 travelling along the external flanks of the two beams (20a, 20b) of the mounting 20 (see FIG. 1a).

It will be appreciated that working member 32 comprises, in a conventional manner, a drilling apparatus and a hammer. In the present invention, working member 32 is no longer used in the lost rod method. The presence of working member 32 is justified to maintain the ability to be able to drill a taphole, if required, with a conventional bit. If conventional drilling is not required or if the conventional drilling can be done in another manner, then working member 32 may be eliminated. If working member 32 is eliminated, then working member 32 is replaced with a simple sliding support which follows the movement of the piercing rod 26 and provides support for piercing rod 26 at the rear.

Rear piercing rod clamp 34 is a bi-directional clamp of the type described in the U.S. application Ser. No. 862,487. The opening and closing of the clamp is controlled by a pneumatic circuit (not shown). Carriage 36 is mounted on a multiplicity of runners 37. Runners 37 are guided in the rails 22, 24 of the mounting 20 and serve as the support for the clamp 34.

At least one endless chain 44 is mounted parallel to the rails 22 and 24 between the two beams 20a and 20b. Chain 44 is tensioned between a driven toothed wheel 45 mounted at the front of the mounting 20 and a driving toothed wheel 46 mounted at the rear of the mounting 20. The driving wheel 46 is driven by at least one motor 42, fixed onto the mounting 20. Motor 42 is preferably a hydraulic motor whose direction of rotation may be reversed by a control module 47 diagrammatically depicted.

Carriage 36 supporting the clamp 34 is fixed to the endless chain 44. Carriage 36 consequently can be driven by endless chain 44 between stop-piece 50 fastened to the front of the mounting 20 and stop-piece 51 mounted at the rear of the mounting 20 and vice versa.

A description of the operation of the machine of this invention for inserting or extracting the piercing rod 26 into and out of the taphole follows below. Piercing rod 26 is preferably loaded into the machine when the machine is in the parked position and clamp 34 occupies a position at the rear of the mounting 20 as shown in FIG. 1. Loading of piercing rod 26, is performed by passing the rod 26 through the open clamp 34 into the support-coupling 30 which is firmly attached to the working member 32.

Figure 2:
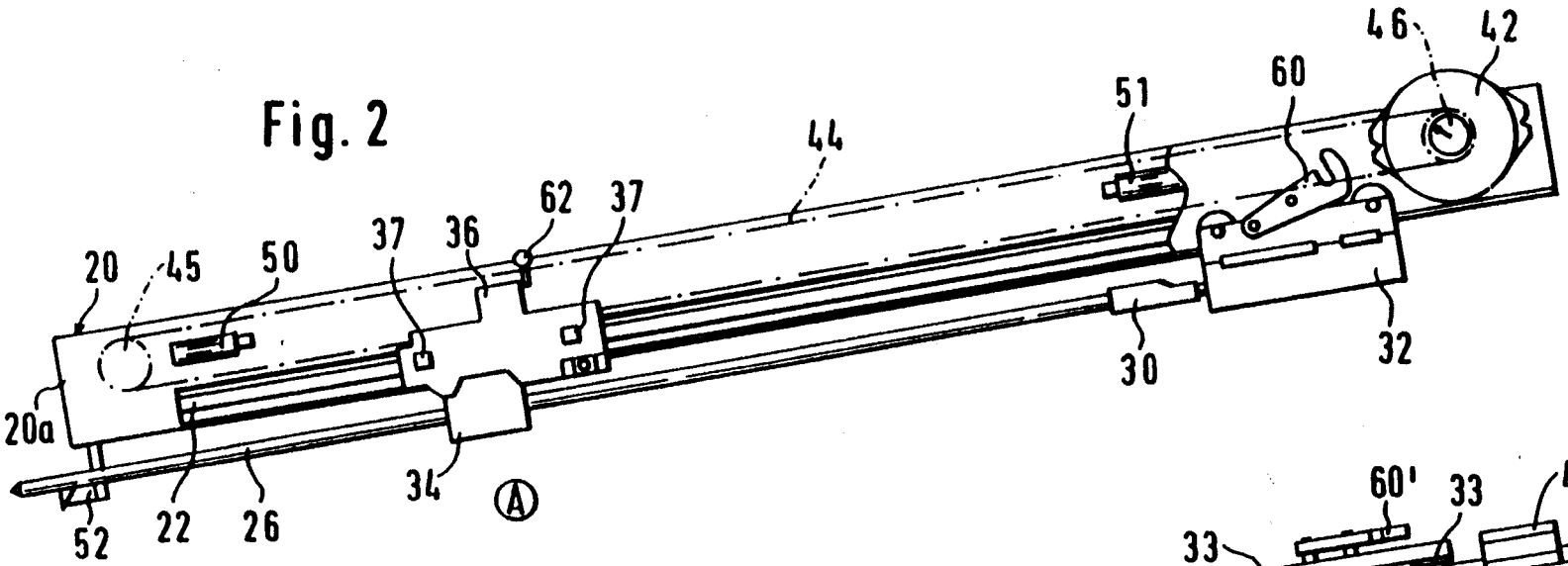
FIG. 2 is a diagrammatical front elevation view of the machine of FIG. 1 just before the first insertion movement of the piercing rod.
Figure 2A:
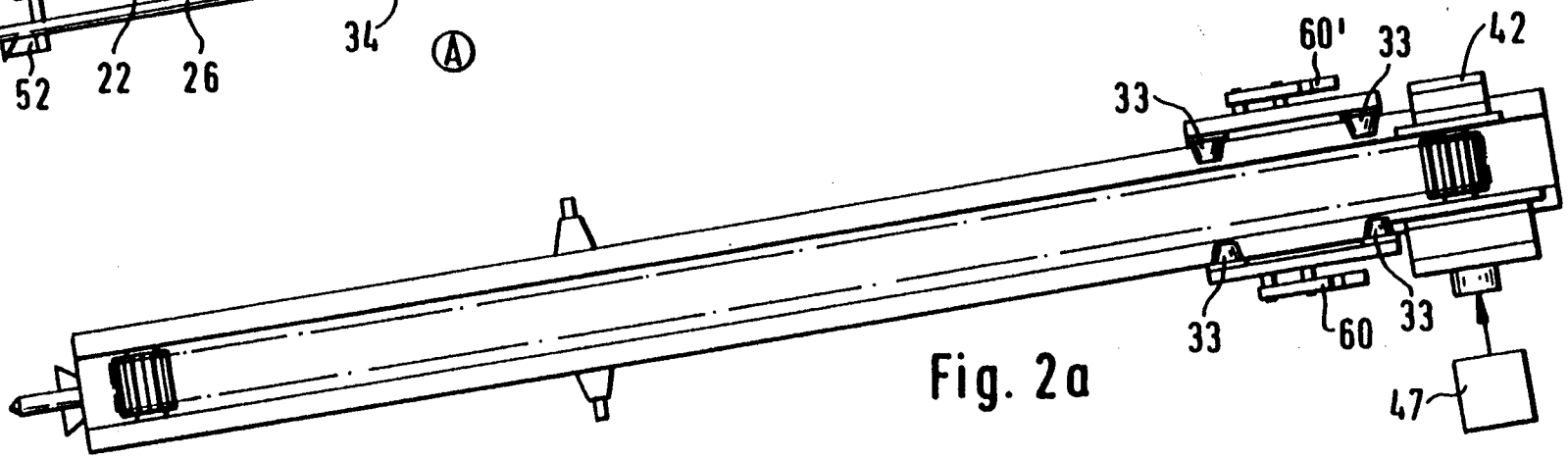
FIG. 2a is a diagrammatical plan view of the machine of FIG. 2.

After the piercing rod 26 is in place (see FIG. 1), the motor 42 is actuated by the control system 47 which causes the endless chain to move in a first direction which advances the clamp 34, which is fully open, into a position A (see FIG. 2). Since the clamp 34 is not activated, clamp 34 is free to slide on piercing rod 26 which is firmly held in the coupling 30 of working member 32.

In principle, it would be possible to advance the clamp 34 into the operative position A as in FIG. 2 before loading the piercing rod 26, but experience has shown that it is easier to engage the piercing rod 26 into the clamp 34 when clamp 34 occupies a position at the rear of the mounting 20 according to FIG. 1.

From the position as shown in FIG. 2, it is possible to start the process of inserting the piercing rod 26 into the taphole clay. In principle, this operation is the same as is disclosed in U.S. application Ser. No. 862,487. For this purpose, the motor 42 and the clamp 34 are activated simultaneously, which has the effect of (1), closing the clamp 34 and (2), moving clamp 34 from position A in FIG. 2 to position B in FIG. 3, thereby driving the piercing rod 26 and the working member 32 which is firmly attached to the piercing rod 26. When position B is reached, the direction of the hydraulic fluid supplying motor 42 is reversed, which has the effect of withdrawing the clamp 34 by a rotation of the motor 42 in the opposite direction. At the same time, the pneumatic circuit control system 47 controls the opening of the clamp 34. The piercing rod 26 remains immobile during this return motion because the clamp 34 is open and can, thus, slide along the piercing rod 26.

Figure 3:
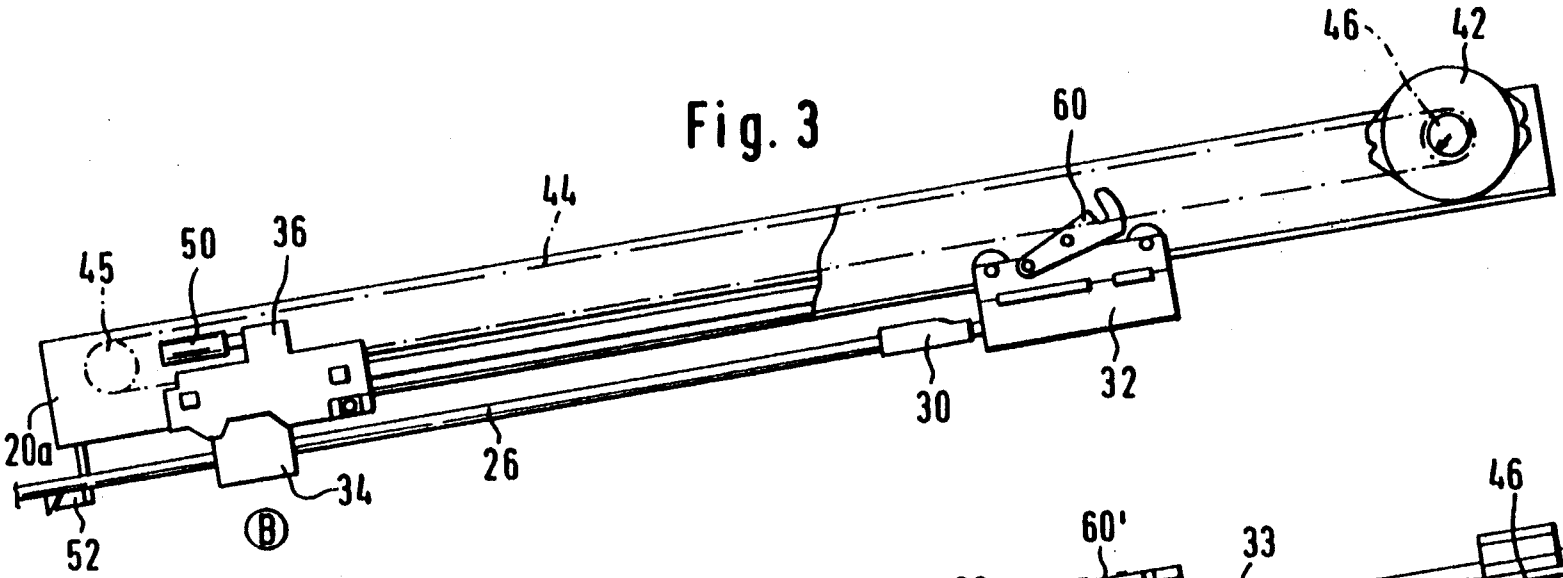
FIG. 3 is a diagrammatical front elevation view of the machine of FIG. 1 just after the first insertion movement of the piercing rod.
Figure 3A:
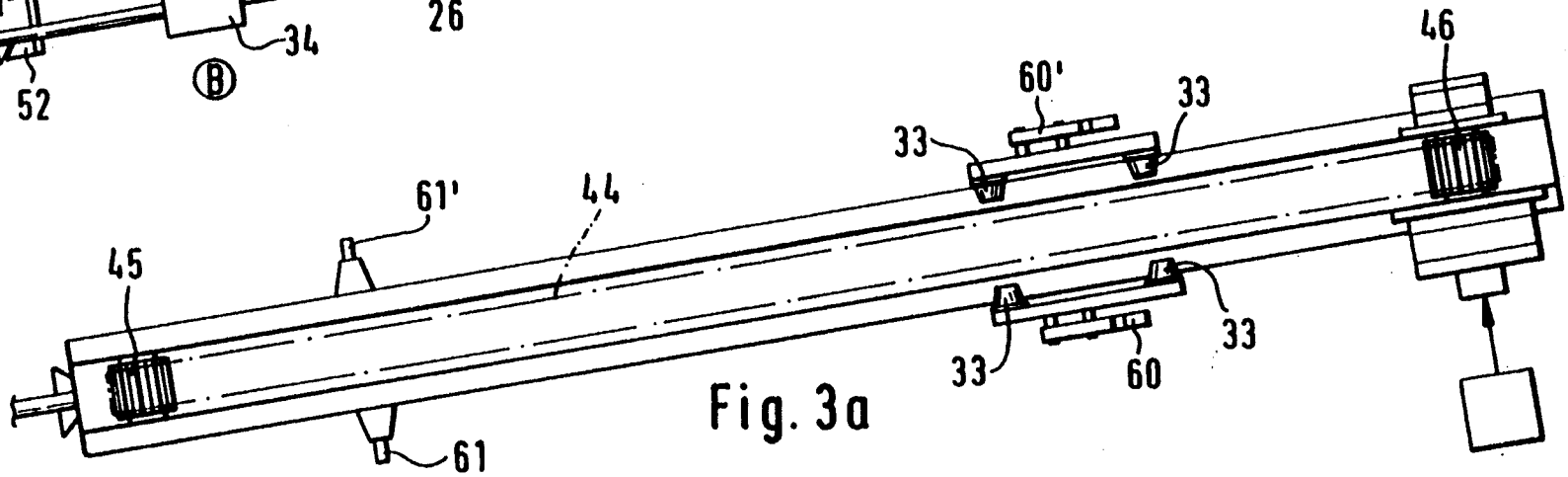
FIG. 3a is a diagrammatical plan view of the machine of FIG. 3.

When carriage 36, once again, arrives at position A, the direction of the hydraulic fluid is again reversed, causing the direction of rotation of motor 42 to change in order to move the clamp 34 towards position B (see FIG. 3). At the same time, the pneumatic circuit control 47 causes clamp 34 to close. This to-and-fro movement of the clamp 34 between position A and the position B is then repeated as many cycles as is necessary for inserting the piercing rod 26 to the desired length into the taphole.

Figure 4:
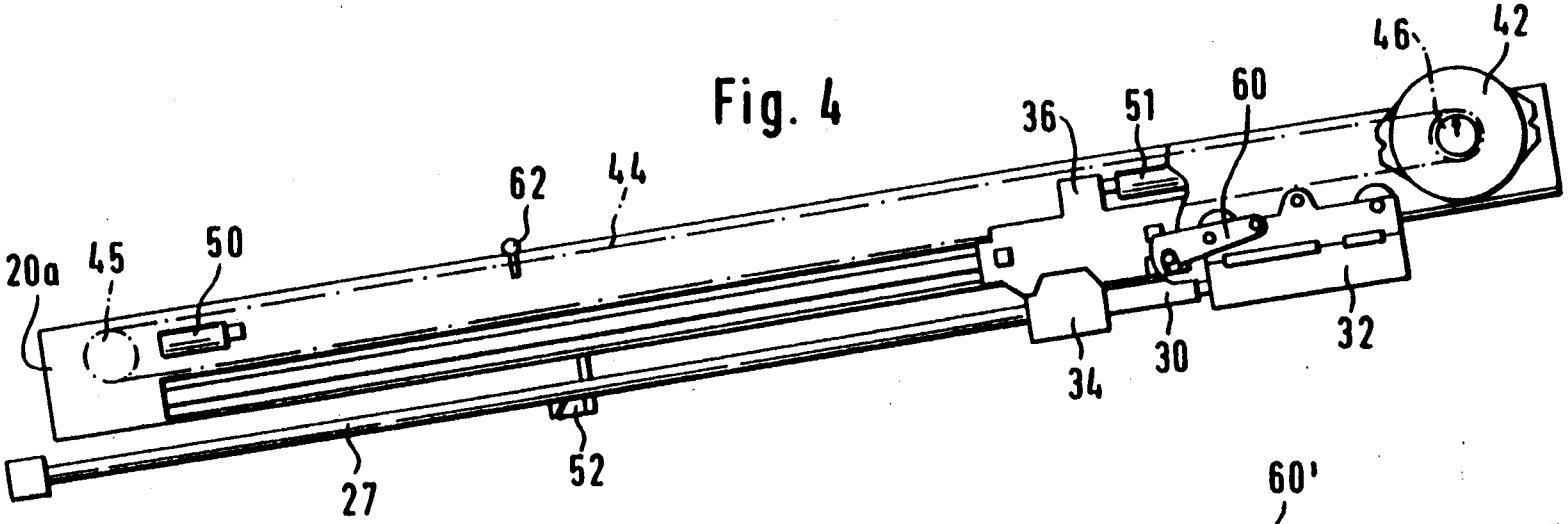
FIG. 4 is a diagrammatical front elevation view of the machine of FIG. 1 shown equipped with a drill bit for a conventional drilling operation.

The change in rotational direction of the motor 42 and the closing and opening of clamp 34 at positions A and B are triggered, for example, by means of two end-of-travel switches. The first end-of-travel switch is associated with stop-piece 50 and the second end-of-travel switch is associated with stop-piece 51. This second end-of-travel switch is depicted diagrammatically in FIGS. 2 and 4 as 53. The distance L between the front stop-piece 50 (equal to position B) and the position A may then be varied by adjusting the second end-of-travel switch at a greater or lesser distance from stop-piece 50.

One possibility for elimination of the second end-of-travel switch is to use the signal from a rev-counter 53 installed on the motor 42 (see FIG. 1*a*) to determine in arithmetic unit 55 (see FIG. 1*a*) the exact position of the carriage 36 on the mounting 20 at all times. This makes it possible to control the direction of rotation of motor 42 via the control modules 47 when the carriage 36 arrives at a predetermined point. It is preferable to use signals from end-of-travel switches which are built into the stop-pieces 50 and 51 in order to calibrate arithmetic unit 55. This set-up produces automatic calibration with each passage of the carriage 36. This arrangement resets the arithmetic unit 55 to zero with each passage of carriage 36 and recalculates the rectilinear displacement of the clamp 34 corresponding to one complete revolution of the motor 42. It is, of course, also possible to carry out measurements of the hydraulic fluid flow rate supplied to motor 42 used to drive chain 44 when motor 42 is a hydraulic motor. In addition, it is possible to carry out measurements of the flow rate of the hydraulic fluid supplying the motor 42 in order to determine the exact moment when the direction of rotation of the motor 42 has to be reversed as well as when the clamp 34 has to be opened or closed.

To extract the piercing rod 26 from the taphole, the mounting 20 is moved towards the taphole. The clamp 34 is moved by the motor 42 to the front of the mounting 20 against the stop-piece 50. When the mounting 20 is correctly positioned in front of the taphole, the free end of piercing rod 26 is engaged through clamp 34 which is in the open position. The pneumatic supply circuit of clamp 34 then controls the closing of clamp 34. Motor 42 may now pull back carriage 36 supporting clamp 34 by means of chain 44 towards the rear of mounting 20 and thus extract the piercing rod from the taphole.

It will be appreciated that in the extraction mode, the carriage 36, when passing to position A in FIG. 2, does not cause release of clamp 34 and reversal of the direction of rotation of the motor. The extraction is thus carried out in a continuous stroke until carriage 36 hits stop-piece 51 which causes the motor to stop automatically.

For the extraction operation, it is possible to use coupling 30 installed on the working member 32. Coupling 30 is a clamp designed for the extraction of piercing rod 26, (e.g., a clamp of the type described in U.S Pat. No. 5,056,986). Clamp 34 could be a unidirectional clamp designed for the insertion of piercing rod 26 (e.g., of the type described in U.S. application Ser. No. 462,415). In this case, clamp 34 remains open and the free end of piercing rod 26 passes through clamp 34 so as to be gripped by the clamp/coupling 30. During its return stroke rearwards, clamp 34 bears directly on clamp-/coupling 30. During its return stroke rearwards, clamp 34 bears directly on clamp/coupling 30 and the working member 32 in front of it. The result is that working member 32 does not have to transmit any traction force to the piercing rod 26.

The arrangement just described does provide some constructional advantages. The construction of clamp 34 is much simpler and in addition only one pneumatic control circuit is required.

Figure 4A:
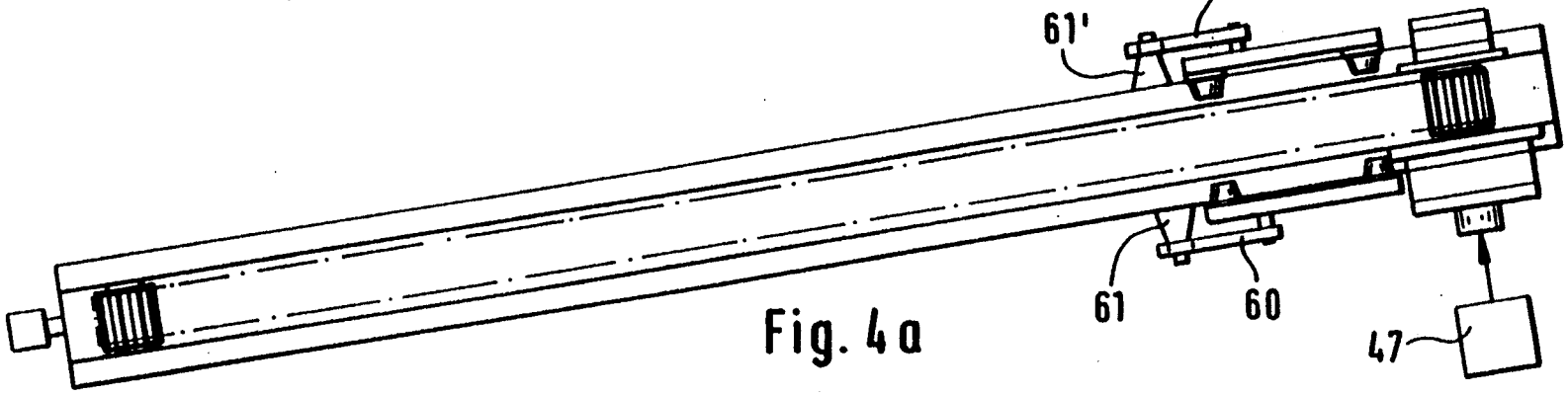

It is also possible to firmly attach carriage 36 supporting clamp 34 and said working member 32 by means of two hooks 60 and 60' located on each side of the working member 32. Hooks 60 and 60' are capable of being engaged automatically or manually with catches 61 and 61' located laterally on said carriage 36. Thus, the working member 32 does not require a specific driving system on the mounting 20 in order to carry out a drilling operation with a conventional drill 27 (see FIGS. 4 and 4*a*).

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A machine for piercing a taphole of a shaft furnace according to a method in which, after having plugged the taphole with taphole clay, a metal rod is driven into this clay, before it has fully hardened, and it is extracted, at the desired time, with a view to opening the taphole, the machine comprising:

a mounting having a front end and rear end;

a front support installed on the mounting so as to support the rod at the front of the mounting:

a rear support which can move on the mounting;

coupling means on said rear support for coupling said rear support to a rear end of the rod, said rear support being freely displaceable along the mounting with the rear end of the rod;

a first clamp mounted in a sliding manner on the mounting so as to be displaceable on said mounting between its front end and its rear end, said rod passing axially through said first clamp, and said first clamp including first gripping means for gripping the rod at any place between said front support and said rear support and transmitting an axial pushing force to the rod, in order to drive the latter into the clay;

second coupling means for being coupled to the rod so as to transmit an axial pulling force to the rod, in order to extract the latter out of the clay, said second coupling means being displaceable as a unit with said first clamp during the extraction of the rod out of the clay;

a rotary motor installed at the rear end of the mounting;

at least one endless chain which is installed axially in the mounting between its front end and its rear end and which can be driven by said rotary motor;

attaching means for attaching the clamp to the endless chain in such a way that it can be driven by the chain between the front end and the rear end of the mounting and vice versa;

first detection means for detecting said clamp at a position (B) located near the front end of the mounting;

second detection means for detecting said clamp at a position (A) located at a distance L from said position (B) in the direction of the rear end of the mounting, said distance L being less than the length of the rod;

first control means for controlling the rotary motor, said first control means being responsive to said first and second detection means so as to generate a repeated movement of the clamp between said position (A) and said position (B) for driving the rod into the clay; and second control means for controlling the rotary motor, said second control means being capable of generating a pull back movement of said first clamp towards the rear end of the mounting beyond said position (A).

2. Machine according to claim 1 wherein said first gripping means are pneumatically operated;

said machine further including a third control means for controlling said first gripping means, said third control means being responsive to said first and second detection means and to said first control means, so as to open the pneumatic clamp automatically in said position (B) before the return towards said position (A) and to close the pneumatic clamp automatically in said position (A) before the return to said position (B).

3. Machine according to claim 1 including:

means for adjusting said distance L.

4. Machine according to claim 1 wherein:

said position (A) is defined by the installation of an end-of-travel switch on the mounting, said switch being actuated by a component which is firmly attached to the endless chain when the clamp is at a distance L from the position (B).

5. Machine according to claim 1 wherein:

the position of the clamp is determined by an arithmetic unit receiving as an input signal the output signal from a rev-counter installed on the motor and wherein said distance L may be entered as a reference value in said arithmetic unit.

6. Machine according to claim 1 wherein:

said rotary motor comprised a hydraulic motor.

7. Machine according to claim 6 wherein:

said control means for controlling the rotary motor includes means for preadjusting the quantity of hydraulic fluid supplying the rotary motor.

8. Machine according to claim 1 including:

a working member mounted in a sliding manner on the mounting and comprising a coupling in order to be coupled to the rear end of the rod.

9. Machine according to claim 8 wherein:

said working member comprises a drilling apparatus and a hammer.

10. Machine according to claim 9 wherein:

said clamp is firmly attached to said working member, the working member then being driven by the clamp attached to the chain.

11. Machine according to claim 9 wherein:

said second coupling means comprises of said first coupling means being attached to said working member and comprising a unidirectional second clamp which may be used to grip the rod and transmit a traction force to the rod; and said first clamp including means for directly bearing on the coupling during the operation of extracting the rod.

12. Machine according to claim 1 wherein:

said clamp includes a second gripping means for gripping the rod in order to transmit a pulling force to the rod.

* * * * *